US006739363B2

(12) United States Patent
Walter et al.

(10) Patent No.: US 6,739,363 B2
(45) Date of Patent: May 25, 2004

(54) FUNNEL SET

(75) Inventors: Glen Walter, Boxford, MA (US); Anne Schloesser, Munich (DE); Benjamin Beck, Boston, MA (US); David Harting, Needham, MA (US)

(73) Assignee: WKI Holding Company, Inc., Reston, VA (US)

( * ) Notice: Subject to any disclaimer, the term of this patent is extended or adjusted under 35 U.S.C. 154(b) by 0 days.

(21) Appl. No.: 10/304,323

(22) Filed: Nov. 26, 2002

(65) Prior Publication Data

US 2003/0106608 A1 Jun. 12, 2003

Related U.S. Application Data

(60) Provisional application No. 60/339,051, filed on Dec. 7, 2001.

(51) Int. Cl.[7] ..... B65B 1/04
(52) U.S. Cl. ..... 141/331; 141/337; 141/340
(58) Field of Search ..... 141/331–345, 141/199–205; D7/700

(56) References Cited

U.S. PATENT DOCUMENTS

| | | | | | |
|---|---|---|---|---|---|
| 135,391 | A | * | 1/1873 | Way | 141/337 |
| 260,079 | A | | 6/1882 | Barnes | |
| 357,476 | A | | 2/1887 | Gersdorff | |
| 559,905 | A | | 5/1896 | Pike | |
| 1,196,784 | A | | 5/1916 | Jasper | |
| 1,612,383 | A | | 12/1926 | Lepeshkin | |
| D143,458 | S | * | 1/1946 | Zabel et al. | D7/700 |
| 2,512,448 | A | * | 5/1950 | Tattersall | 383/36 |
| 2,703,670 | A | | 3/1955 | Voight | |
| 2,868,246 | A | * | 1/1959 | Nelson | 141/286 |
| 2,924,253 | A | * | 2/1960 | Beddow | 141/337 |
| 2,933,110 | A | * | 4/1960 | Sharp | 141/98 |
| 4,471,563 | A | | 9/1984 | Lindgren | |
| 4,494,581 | A | | 1/1985 | Gordon | |
| 4,823,848 | A | | 4/1989 | Sentmore, Sr. et al. | |
| 5,123,461 | A | | 6/1992 | Belokin, Jr. et al. | |
| 5,195,567 | A | | 3/1993 | Tyree, Jr. | |
| 5,381,839 | A | | 1/1995 | Dowd | |
| 5,511,595 | A | | 4/1996 | Stidham | |
| 5,867,867 | A | | 2/1999 | Kessler | |
| 5,920,916 | A | | 7/1999 | Norton | |
| 6,035,907 | A | | 3/2000 | DeCoster | |
| D426,283 | S | | 6/2000 | Hernandez | |
| 6,083,392 | A | | 7/2000 | Rigney | |
| 6,119,739 | A | | 9/2000 | McGee et al. | |
| 6,142,193 | A | | 11/2000 | Sanders | |

* cited by examiner

*Primary Examiner*—Steven O. Douglas
(74) *Attorney, Agent, or Firm*—Seyfarth, Shaw LLP

(57) ABSTRACT

A funnel set includes a large funnel and a small funnel nestable therein and a strainer which can be seated in either funnel. The large funnel has lugs to retain the strainer and the strainer has an upstanding central handle stem. When the strainer is seated in the large funnel and the small funnel is nested in the large funnel, the narrow outlet end of the small funnel receives the strainer's handle stem and the tip of a handle on the small funnel fits within an aperture in the handle of the large funnel. Both funnels have longitudinal, circumferentially spaced, elastomeric strips on the outer surfaces thereof, and elastomeric grip portions on the handles.

22 Claims, 8 Drawing Sheets

FUNNEL SET

RELATED APPLICATION

This application claims the benefit of the filing date of copending U.S. Provisional Application No. 60/339,051, filed Dec. 7, 2001.

BACKGROUND

This application relates to funnels and, in particular, to funnels of the type designed for household use. The application relates in particular to sets of funnels of different sizes.

A wide variety of shapes and sizes of funnels has heretofore been provided for a variety of different general household applications, including applications for use in the kitchen, automotive uses and the like. A funnel typically includes a relatively wide-mouthed upper bowl region and a narrow spout opening designed to be fitted into the openings of associated receptacles into which material is to be poured. Funnels are commonly provided with tapered spouts so that they will fit in a variety of different-sized receptacle necks or inlet openings. However, prior funnels have been susceptible to slipping or tilting sideways in use, particularly funnels having relatively short outlet spouts or necks.

It is also known to provide funnels in sets of different sizes for different applications. However, heretofore, such sets of different-sized funnels have not been characterized by designs which facilitate compact, nested storage.

It is also known to provide funnels with built-in or removable strainers, but such strainers are typically designed for use with a specific size and shape of funnel and tend to impair nesting of sets of funnels.

It is also known to provide funnels with handles to facilitate grasping in use. However, heretofore, such handles have tended to impair the nesting of sets of funnels and have either been relatively large or have been difficult to grasp, securely, particularly for people with impaired grasping ability.

SUMMARY

This application discloses an improved funnel construction and a set of funnels which avoid the disadvantages of prior funnel arrangements while affording additional structural and operating advantages.

An aspect is the provision of a funnel which is readily adapted for use with different-sized receptacle openings, while inhibiting slipping or sliding sideways movement in such openings.

A further aspect is provision of a funnel of the type set forth which provides an improved ergonomic handle with an improved grip which facilitates nesting of plural funnels.

A further aspect is the provision of a set of different-sized funnels which can conveniently be stored by nesting one within another.

Yet another aspect is the provision of a funnel set of the type set forth with a removable strainer which is useable with each of the different-sized funnels.

In connection with the foregoing aspect, a still further aspect is the provision of a funnel set of the type set forth wherein the strainer can be nested for storage between adjacent funnels of the set.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figures 1, 2:
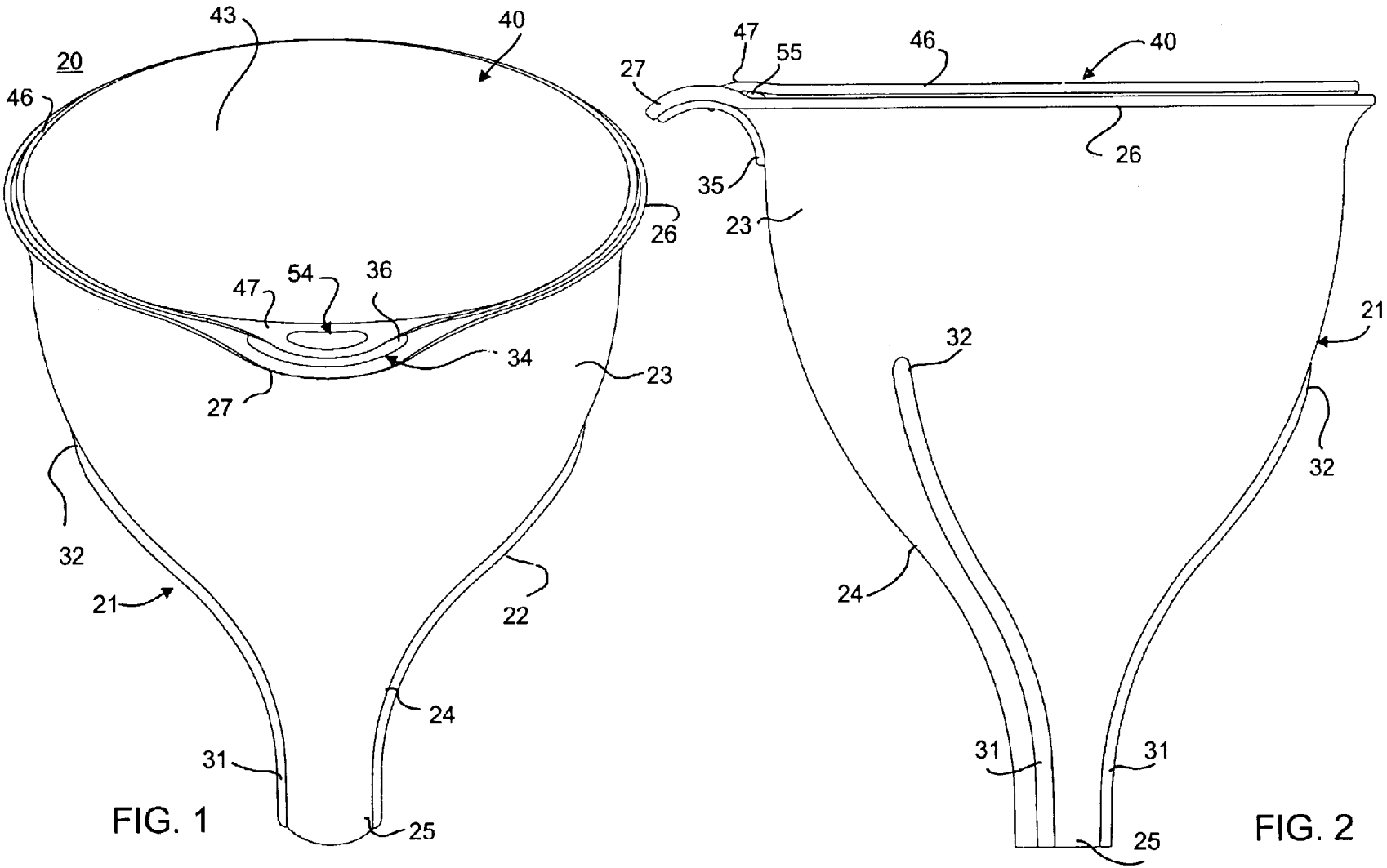
FIG. 1 is a perspective view of a funnel set in a nested condition.
FIG. 2 is a side elevational view of the funnel set of FIG. 1.
Figure 4:
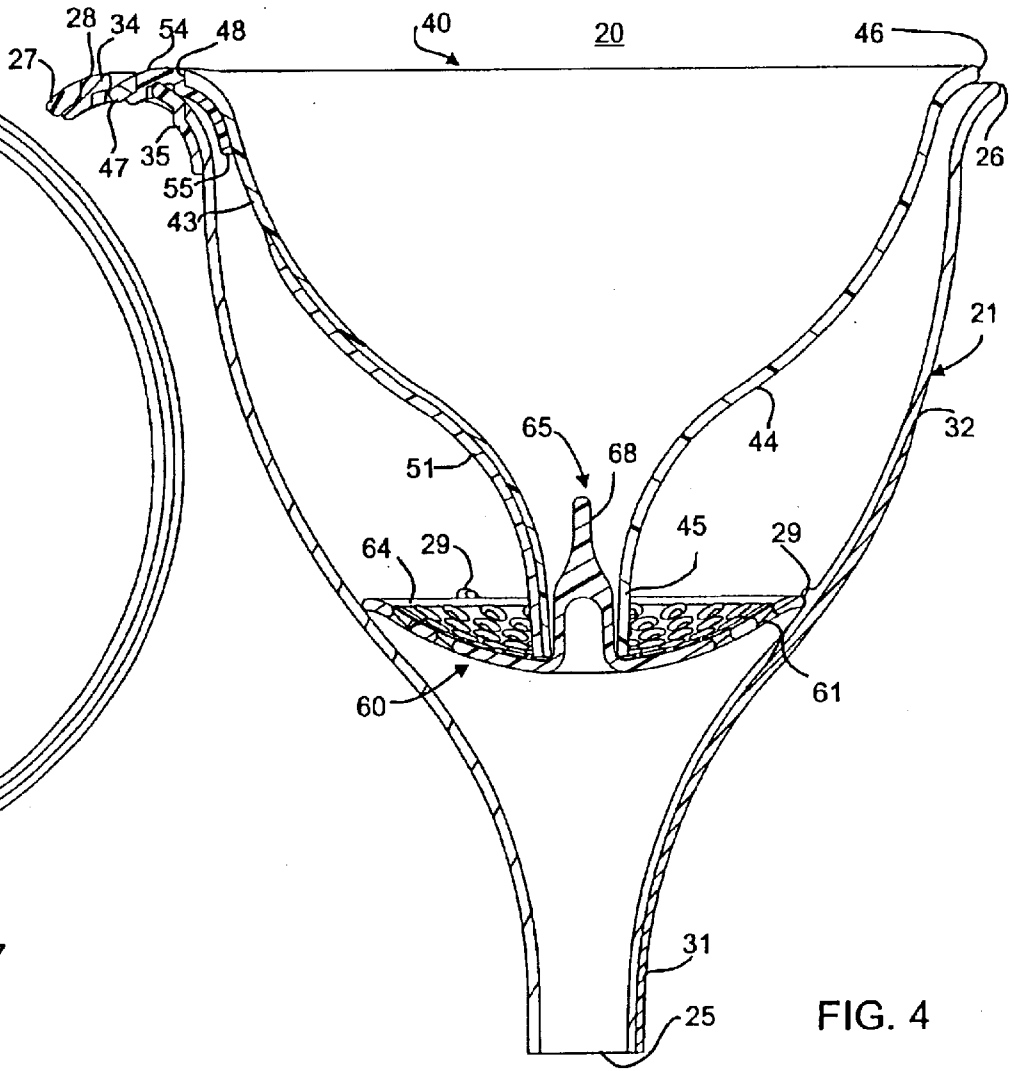
FIG. 4 is a sectional view taken along the line 4—4 in FIG. 3.
Figure 6:
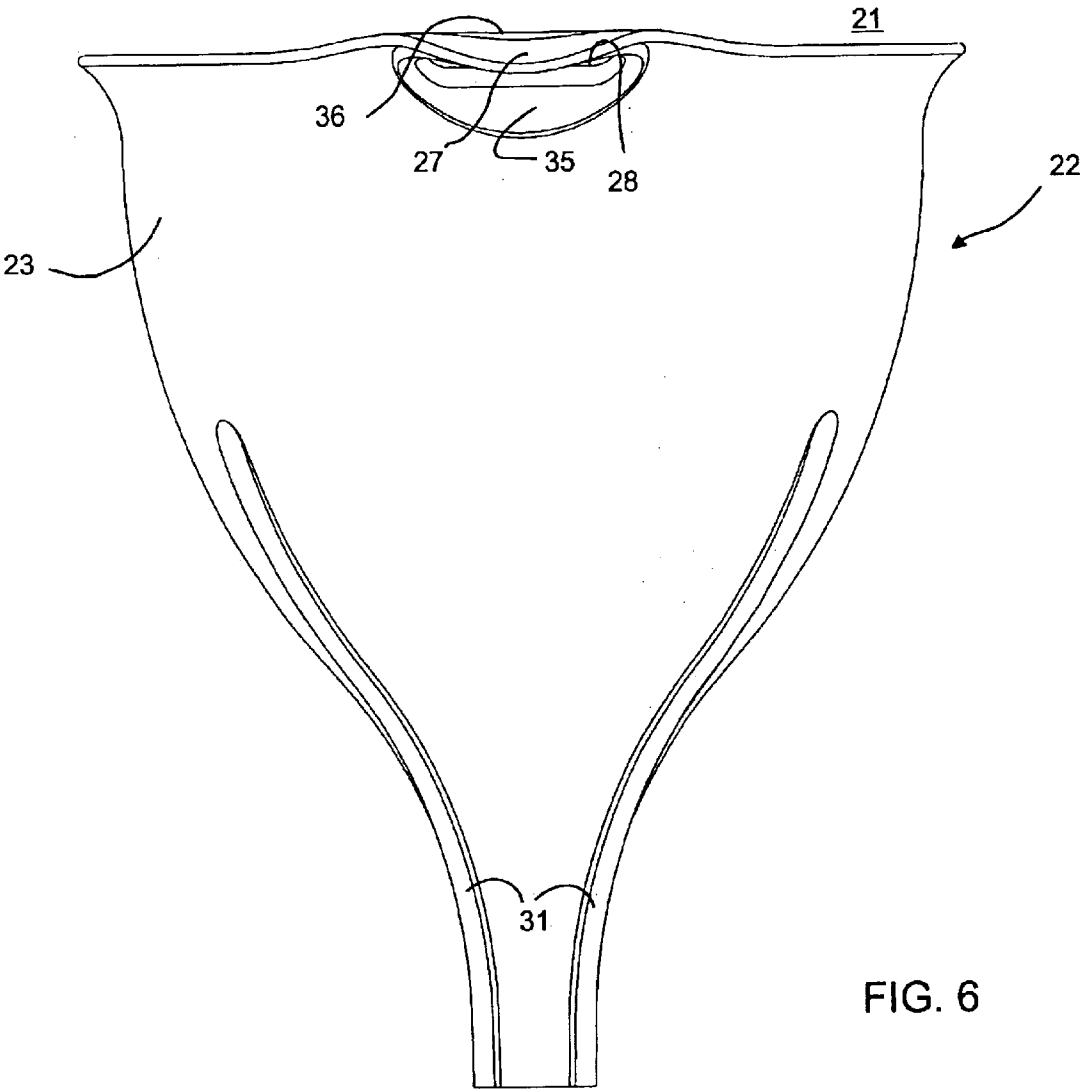
FIG. 6 is a front elevational view of the large funnel of the set of FIG. 1.
Figure 8:
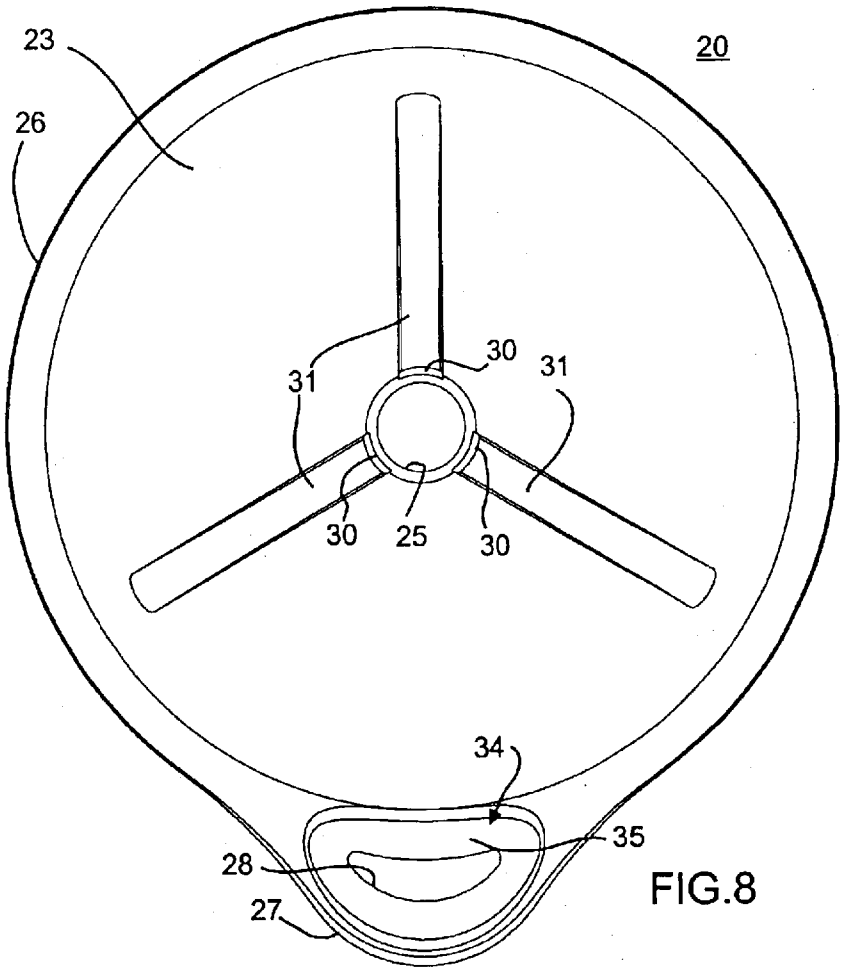
FIG. 8 is an enlarged bottom plan view of the funnel of FIG. 6.
Figure 7:
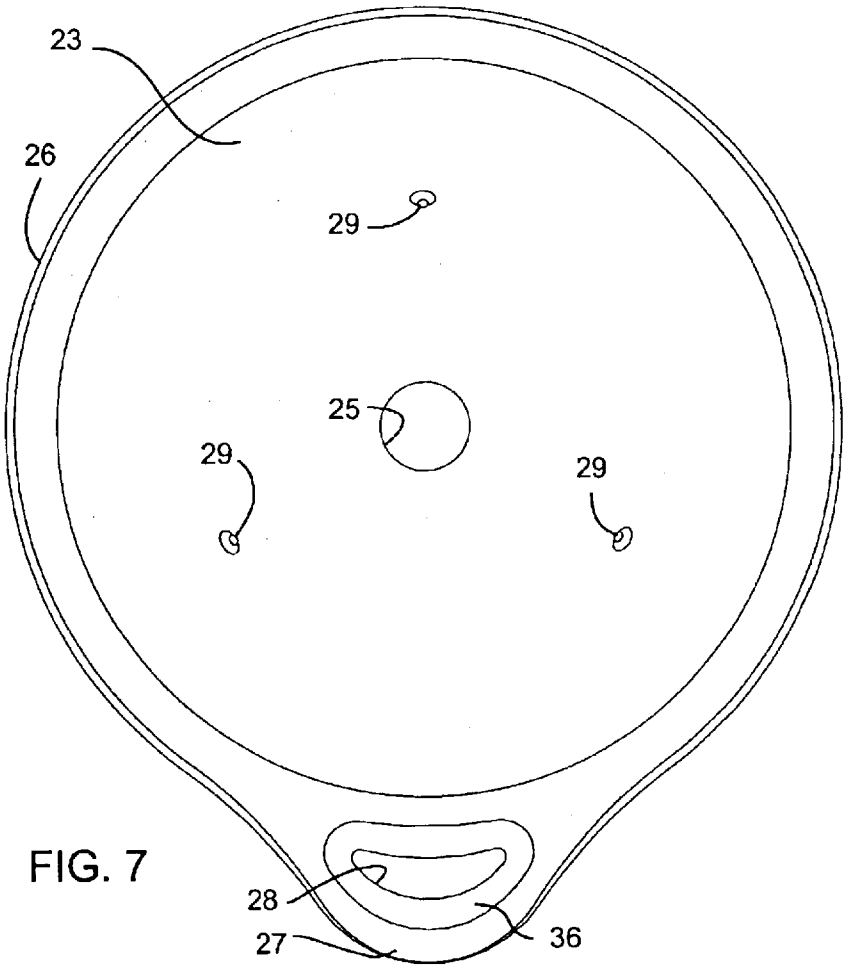
FIG. 7 is an enlarged top plan view of the funnel of FIG. 6.

Referring to FIGS. 1–5, there is illustrated a funnel set, generally designated by the numeral 20, including a large funnel 21, a small funnel 40 and a strainer 60, all shaped and sized so that they can be nested together for storage, as can best be seen in FIG. 4. Referring also to FIGS. 6–8, the large funnel 21 has a one-piece body 22 formed, as by molding, of a suitable plastic material which is resistant to high heat, so that it can be used for pouring boiling liquids, and may also be designed to be resistant to common household liquids or chemicals with which it may be used. Suitable materials may include nylon or polypropylene. The body 22 is substantially circular in transverse cross section with a continuously curved longitudinal cross-sectional shape of variable slope, and includes a relatively large-diameter upper bowl 23, the lower end of which is joined by a tapered neck 24 to a short, substantially cylindrical spout 25, which terminates at a narrow end to define a narrow outlet opening. The upper end of the bowl 23 is provided with an out-turned lip 26, which defines a wide inlet opening or mouth for the funnel 20, and is provided at one side with a laterally outwardly projecting handle 27, having a generally oval-shaped opening 28 formed therethrough. Projecting laterally inwardly from the inner surface from the body 22 are three short, equiangularly spaced-apart lugs 29 (FIGS. 4 and 7) which lie in a common plane disposed substantially perpendicular to the longitudinal axis of the funnel 21, for a purpose to be explained more fully below.

Formed in the outer surface of the body 22 are three equiangularly spaced-apart, shallow recesses or grooves 30 (see FIG. 8) which extend longitudinally from the distal end of the spout 25 up into the lower region of the bowl 23, each recess 30 being substantially rectangular in shape, but with a rounded upper end. Respectively fixedly secured in the recesses 30 are three elongated strips 31 formed of an elastomeric material, such as that sold under the trade name SANTOPRENE, each strip 31 having a thickness such that it projects slightly outwardly of the outer surface of the body 22, as can be seen, for example in FIGS. 2 and 6, but thinning to blend into the outer surface of the body 22 at upper ends 32. The handle 27 is slightly curved, having a convex upper surface and a concave lower surface, and projects upwardly slightly above the level of the lip 26 and terminates at a distal end which may be slightly below of the level of the lip 26, as can best be seen in FIGS. 5 and 6. The handle 27 is provided with a grip pad 34 formed of an elastomeric material, which may be the same material as is used for the strips 31. The grip pad 34 lines the inside of the opening 28 and has a lower part 35 which covers most of the underside of the handle 27 and extends slightly downwardly along the outside of the bowl 23, and an upper part 36 which extends around the periphery of the opening 28. It will be appreciated that the grip pad 34 provides improved frictional gripping surfaces to facilitate gripping of the handle 27 by the thumb and forefinger of a user, being particularly helpful when the handle 27 is wet. The tapered construction of the neck 24 facilitates use of the funnel 21 in a variety of different-sized receptacle openings. The strips 31 provide a secure frictional fit in the opening of the associated receptacle to inhibit lateral or rotational sliding of the funnel in the receptacle neck, thereby minimizing the chance of spillage in use. The strips 31 also permit the regions of the body 22 therebetween to form vent openings to facilitate displacement of air from the receptacle being filled.

Referring also to FIGS. 9–12, the small funnel 40 is similar in construction in the large funnel 21, except that it is of a smaller size and accordingly somewhat different shape, and lacks the lugs 29. More specifically, the small funnel 40 has a one-piece body 42 which may be formed of the same material as the body 22 of the large funnel 21. The body 42 has a large-diameter bowl 43 which is joined at its lower end by a tapered neck 44 to a short cylindrical outlet spout 45, which terminates at a narrow end to define a narrow outlet opening. The upper end of the bowl 43 is provided with a laterally out-turned lip 46 around the circumference thereof, which defines a wide inlet opening or mouth for the funnel 40, and is provided at one side with a laterally outwardly projecting handle 47, which may be curved similarly to the handle 27 of the large funnel 21 and has a generally oval-shaped opening 48 formed therethrough.

Formed in the outer surface of the body 42 at equiangularly spaced-apart locations are three shallow recesses or grooves 50 (see FIG. 12.), each extending longitudinally from the distal end of the spout 45 to approximately midway along the height of the bowl 43, each recess 50 being substantially rectangular in shape, but with a rounded upper end. Respectively secured in the recesses 50 are strips 51 of elastomeric material, which may be the same as the material of the strips 31, described above. Each strip 51 has a thickness such that it projects slightly outwardly of the outer surface of the body 42, but thinning to blend into the outer surface of the body 42 at an upper end 52. Handle 47 is provided with a grip pad 54 of elastomeric material, which may be the same as that of the grip pad 34, described above. The grip pad 54 has a lower part 55 which covers most of the underside of the handle 47, extending a slight distance downwardly along the outer surface of the bowl 43 (see FIG. 10). The grip pad 54 also has a upper part 56 which extends through and fills the opening 48. The small funnel 40 functions in substantially the same manner as was described above for the large funnel 21. It will be appreciated that the small funnel 40 is sized and shaped so that it can be nested within the large funnel 21 for storage purposes, as illustrated, for example, in FIGS. 1–5. In this regard, the opening 28 in the handle 27 of the large funnel 21 accommodates the tip of the small funnel handle 47 (see FIGS. 1 and 4).

Referring now also to FIGS. 13–17, the strainer 60 includes a perforated plastic body 61 which is formed generally in the shape of a shallow bowl, preferably being of unitary, one-piece construction. For example, the strainer 60 may be molded of the same type of material as is used for the funnels 21 and 40. The body 61 has a plurality of substantially circular apertures 62 formed therethrough and is provided with a slightly larger circular central opening 63 therethrough. The upper edge of the body 61 is provided with a rounded circumferential rim 64. A handle 65 projects upwardly from the upper surface of the body 61 centrally thereof The handle 65 includes a hollow circularly cylindrical stem 66 coaxial with the central opening 63 and communicating therewith, being provided along its outer surface with a plurality of equiangularly spaced, longitudinally extending stiffening flanges 67, which join the upper surface of the body 61. The upper end of the stem 66 is provided with inwardly tapered opposite sides 68, which cooperate to define a thin, flattened grip 69.

Figure 10:
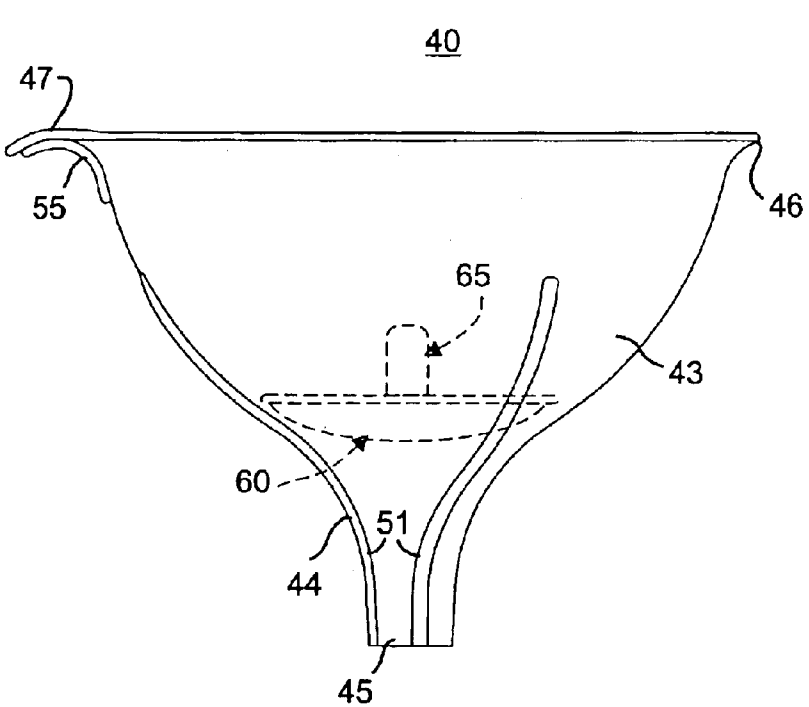
FIG. 10 is a side elevational view of the funnel of FIG. 9 with the strainer of FIG. 5 shown seated therein in broken lines.
Figure 9:
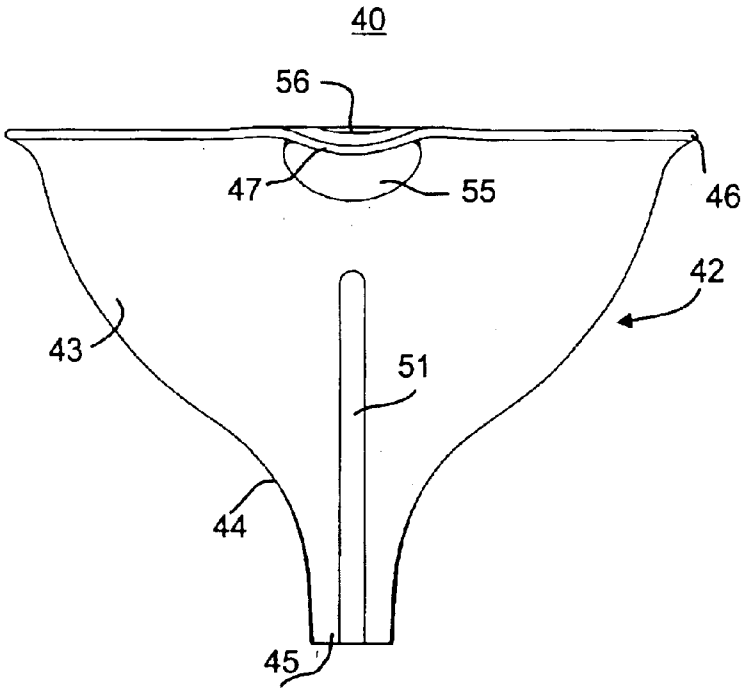
FIG. 9 is a front elevational view of the small funnel of the set of FIG. 1.
Figure 12:
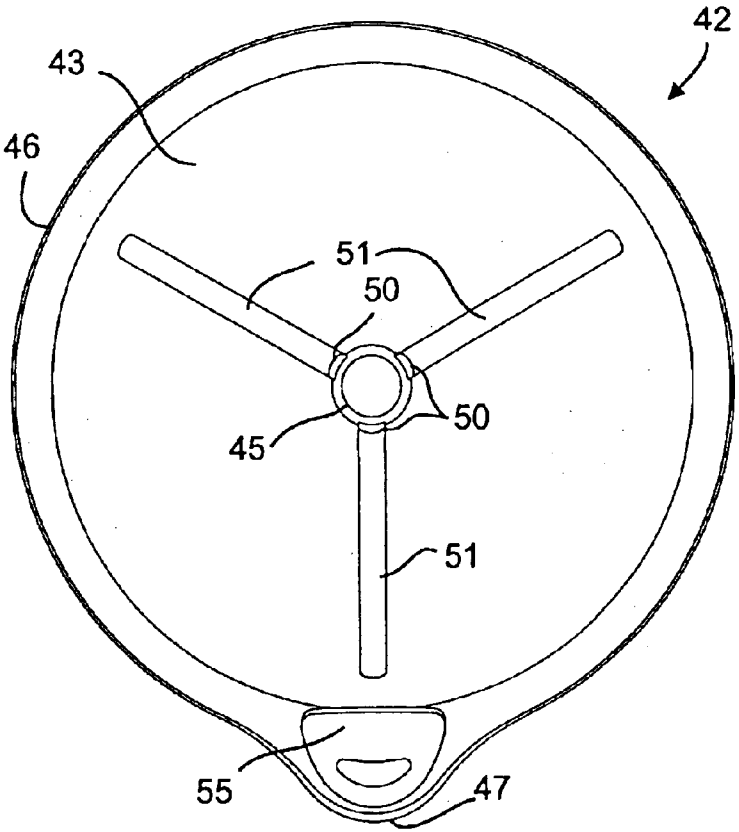
FIG. 12 is an enlarged bottom plan view of the funnel of FIG. 9.
Figure 11:
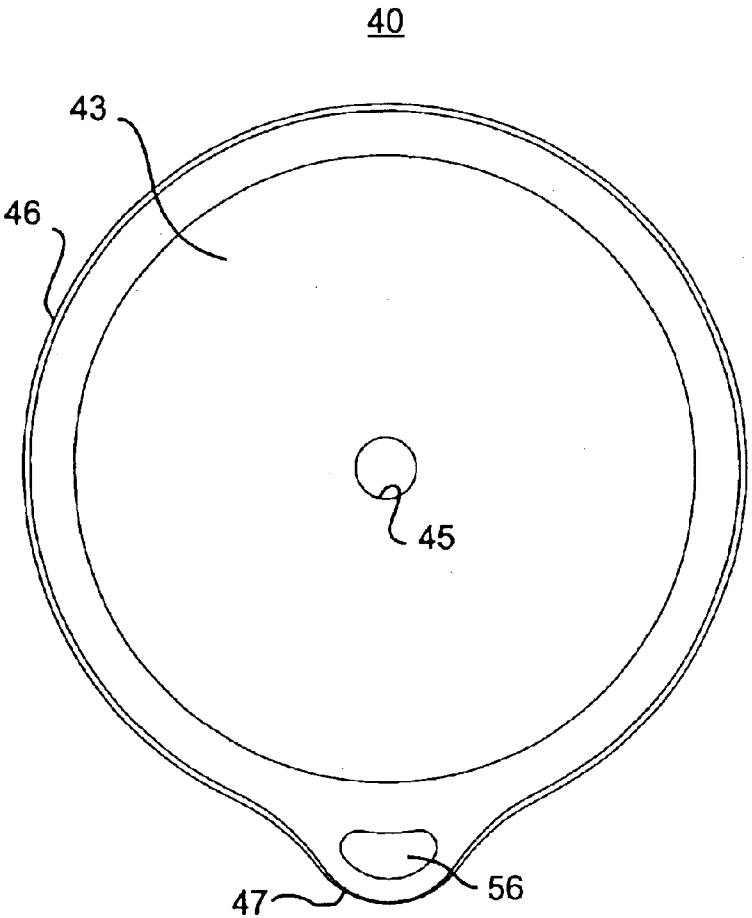
FIG. 11 is an enlarged top plan view of the funnel of FIG. 9.
Figure 13:
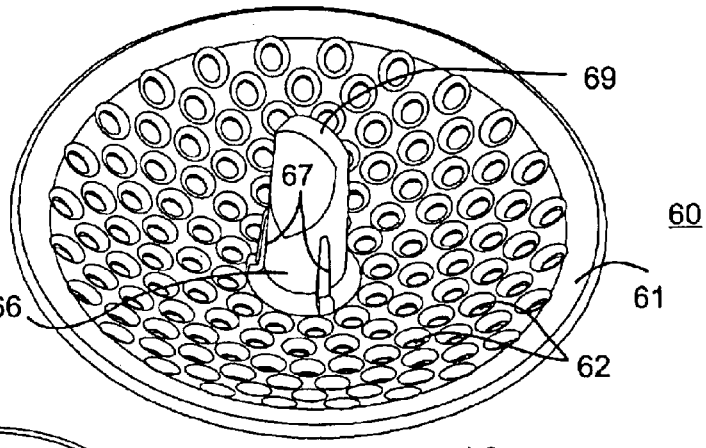
FIG. 13 is an enlarged perspective view of the strainer of the set of FIGS. 1–5.
Figure 14:
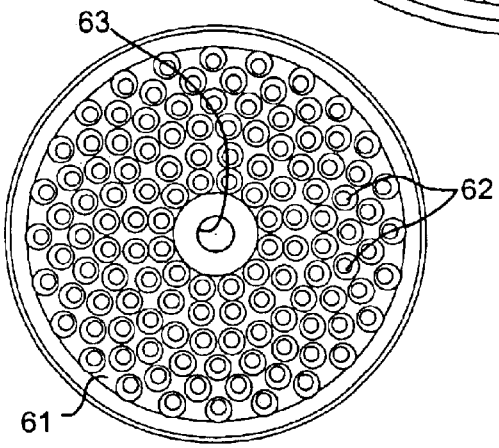
FIG. 14 is a reduced bottom plan view of the strainer of FIG. 13.
Figure 16:
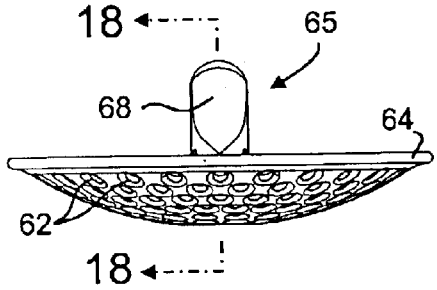
FIG. 16 is a front elevational view of the strainer of FIG. 15.
Figure 17:
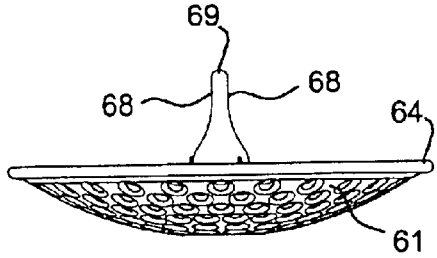
FIG. 17 is a side elevational view of the strainer of FIG. 15.
Figure 15:
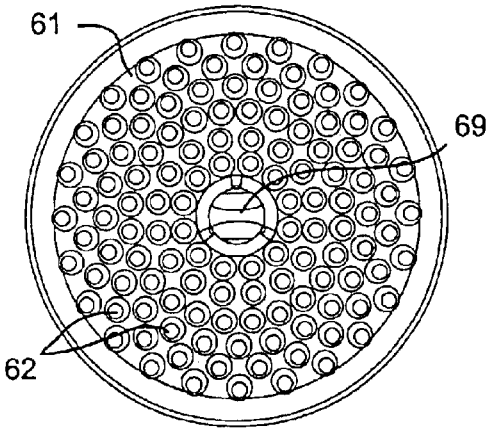
FIG. 15 is a reduced top plan view of the strainer of FIG. 13.
Figure 18:
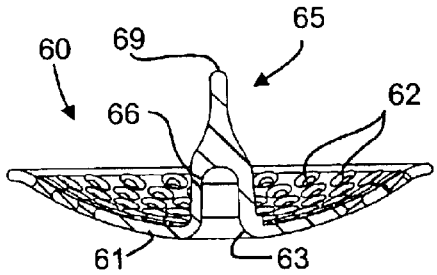
FIG. 18 is a sectional view taken along the line 18—18 in FIG. 16.

In use, the strainer 60 may be seated in either of the large or small funnels 21 or 40, as illustrated in FIGS. 4 and 10, such as for straining particulates from poured liquids or the like. The strainer 60 is shaped so that its rim 64 can snap past the lugs 29 on the large funnel 21, so that the lugs 29 will serve to retain it in position, as illustrated in FIG. 4.

Figure 3:
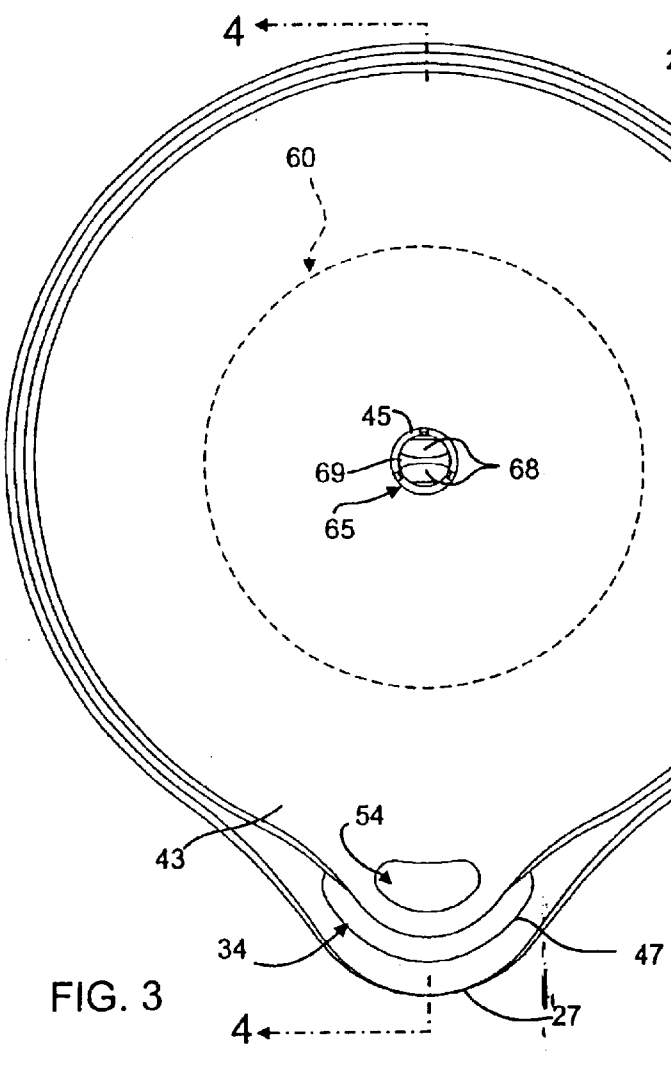
FIG. 3 is a top plan view of the set of FIG. 2, rotated 90° counterclockwise.
Figure 5:
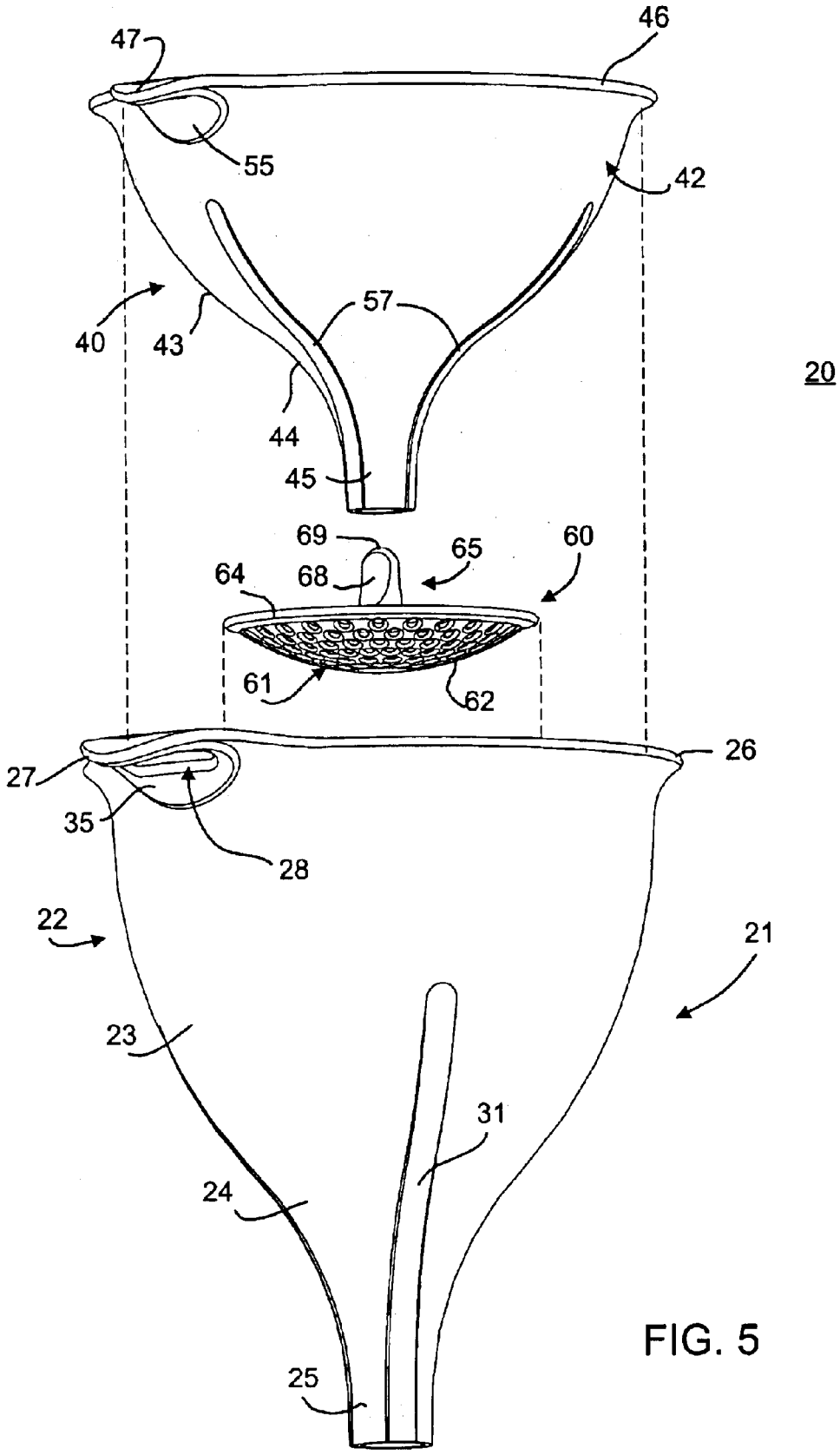
FIG. 5 is a reduced, exploded, perspective view of the funnel of FIG. 1.

Significantly, all three parts of the funnel set can be nested together for storage, as can be seen in FIGS. 3 and 4. For this purpose the strainer 60 is seated in the large funnel 21 and then the small funnel 40 is nested in the large funnel 21, so that the handle 65 of the strainer 60 projects upwardly into the spout 45 of the small funnel 40, serving to maintain the parts in a coaxial arrangement.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A funnel comprising:

an elongated rigid hollow body with an exterior and an interior and having a wide end defining a wide inlet opening and a narrow end defining a narrow outlet opening, and a plurality of longitudinally extending strips disposed on the exterior of the body and projecting laterally outwardly therefrom at spaced locations, each strip being formed of an elastomeric material.

2. The funnel of claim 1, wherein the strips are equiangularly spaced around the body.

3. The funnel of claim 1, wherein the strips are three in number.

4. The funnel of claim 1, wherein each of the strips extends from the narrow end toward the wide end.

5. The funnel of claim 4, wherein each of the strips has an upper end spaced substantially from the wide end of the body.

6. The funnel of claim 1, wherein the body has a plurality of longitudinally extending shallow recesses formed in the exterior thereof, the strips being respectively disposed in the recesses.

7. The funnel of claim 1, wherein the body is substantially circular in transverse cross section.

8. A funnel comprising:

an elongated rigid hollow body with an exterior and an interior and having a wide end defining a wide inlet opening and a narrow end defining a narrow outlet opening, and a handle extending laterally outwardly from the body adjacent to the wide end thereof, the handle including a grip portion formed of an elastomeric material.

9. The funnel of claim 8, wherein the handle has a convex upper surface and terminates at a distal end.

10. The funnel of claim 8, wherein the handle has an aperture therethrough.

11. The funnel of claim 8, wherein the handle has upper and lower surfaces between which the aperture extends, the grip portion extending through the aperture and along the lower surface.

12. The funnel of claim 11, wherein the grip portion substantially fills the aperture.

13. The funnel of claim 8, and further comprising a plurality of longitudinally extending strips disposed on the exterior of the body and projecting laterally outwardly therefrom at spaced locations, each strip being formed of an elastomeric material.

14. The funnel of claim 13, wherein each of the strips extends from the narrow end of the body toward the wide end thereof.

15. A funnel set comprising:

a first relatively large funnel having a tapered hollow first body with wide and narrow end openings, a second funnel having a tapered hollow second body with wide and narrow end openings and dimensioned to be nestably received in the wide end opening of the first body, and a strainer dimensioned to be seated in the first body between the wide and narrow end openings without interfering with nesting of the second funnel in the first body above the strainer.

16. The funnel set of claim 15, wherein each of the first and second bodies has a curved shape which has a slope which varies from the wide end opening to the narrow end opening thereof.

17. The funnel set of claim 15, wherein the first body is provided with a plurality of laterally inwardly projecting lugs intermediate the end openings thereof for cooperation to position the strainer.

18. The funnel set of claim 15, wherein the strainer has an upstanding central handle stem which is receivable in the narrow end opening of the second body when the second funnel is nested within the first funnel.

19. The funnel set of claim 15, wherein each of the first and second funnels has a laterally outwardly extending handle adjacent to the wide end opening thereof.

20. The funnel set of claim 19, wherein each of the handles has an aperture therethrough and terminates at a distal end, the distal end of the handle of the second funnel being receivable in the aperture in the handle of the first funnel when the second funnel is nested within the first funnel.

21. The funnel set of claim 19, wherein each of the funnel handles includes a grip portion formed of an elastomeric material.

22. The funnel set of claim 15, wherein each of the first and second bodies includes a plurality of longitudinally extending strips disposed on the exterior of the body and projecting laterally outwardly therefrom at spaced locations.

* * * * *